US005722590A

United States Patent [19]

Miller

[11] Patent Number: 5,722,590

[45] Date of Patent: Mar. 3, 1998

[54] ILLUMINATED STRAW DEVICE

[76] Inventor: Jason Everett Miller, P.O. Box 3394, S. El Monte, Calif. 91733

[21] Appl. No.: 716,857

[22] Filed: Sep. 18, 1996

[51] Int. Cl.[6] ..... A47G 21/18

[52] U.S. Cl. ..... 239/33; D7/300.2

[58] Field of Search ..... 239/33, 24; D7/300.2

[56] References Cited

U.S. PATENT DOCUMENTS

| | | | |
|---|---|---|---|
| D. 371,269 | 7/1996 | Shattuck et al. | D7/300.2 |
| 4,812,952 | 3/1989 | Clemens | D7/300.2 X |
| 4,854,712 | 8/1989 | Mori | D7/300.2 X |

FOREIGN PATENT DOCUMENTS

| | | | |
|---|---|---|---|
| 4-253814 | 9/1992 | Japan | 239/33 |

*Primary Examiner*—Lesley D. Morris

[57] ABSTRACT

An illuminated straw device including a tubular member defined by an annular wall that has an interior surface and an exterior surface. The tubular member has a channel being formed within the exterior surface. The channel has a channel wall with a plurality of bulbous projections extending outwardly and a plurality of holes therein. Also, at least one strip of an illuminating material is included. The strip has a front face and a rear face with a plurality of bulbous projections extending outwardly and a plurality of holes therein. The strip of illuminating material is sized and shape for positioning within the channel of the tubular member. The strip is coupled with the tubular member when the bulbous projections of the channel engage the holes of the strip and the bulbous projections of the strip engage the holes of the channel.

14 Claims, 3 Drawing Sheets

ILLUMINATED STRAW DEVICE

BACKGROUND OF THE INVENTION

1. Field of the Invention

The present invention relates to an illuminated straw device and more particularly pertains to providing lighted straw for lighting a consumable liquid when the straw is placed within the liquid.

2. Description of the Prior Art

The use of a straw is known in the prior art. More specifically, straws heretofore devised and utilized for the purpose of drinking a consumable liquid are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,854,712 to Mori discloses a multi-color luminous stirrer. U.S. Pat. Des. No. 332,198 to Goodman discloses a drinking straw. U.S. Pat. Des. No. 301,104 to Hammerquist discloses a chemically lighted swizzle stick. U.S. Pat. No. 4,134,494 to Wong discloses a combination straw and stirrer. Lastly, U.S. Pat. No. 4,812,952 to Clemens discloses a self-illuminating floral device.

While these devices fulfill their respective, particular objectives and requirements, the aforementioned patents do not describe Illuminated straw device that allows the consumable drink of the user to be lit by the straw device for entertainment purposes.

In this respect, the illuminated straw device according to the present invention substantially departs from the conventional concepts and designs of the prior art, and in doing so provides an apparatus primarily developed for the purpose of providing lighted straw for lighting a consumable liquid when the straw is placed within the liquid.

Therefore, it can be appreciated that there exists a continuing need for a new and improved illuminated straw device which can be used for providing lighted straw for lighting a consumable liquid when the straw is place withing the liquid. In this regard, the present invention substantially fulfills this need.

SUMMARY OF THE INVENTION

In view of the foregoing disadvantages inherent in the known types of straws now present in the prior art, the present invention provides an improved illuminated straw device. As such, the general purpose of the present invention, which will be described subsequently in greater detail, is to provide a new and improved illuminated straw device and method which has all the advantages of the prior art and none of the disadvantages.

To attain this, the present invention essentially comprises an elongated tubular member defined by an annular wall that has an interior surface and an exterior surface. The tubular member has a length and a circular cross-section. The tubular member has a pair of linear channels that are formed within the exterior surface and extend the length of the tubular member. Each linear channel has a channel wall with a plurality of bulbous projections extending outwardly therefrom and a plurality of holes therein. The plurality of bulbous projections are positioned along the length of the channel wall in an ordered fashion. The plurality of holes are sequentially positioned between the projections and along the length of the channel wall. Included are two strips of an illuminating material. Each strip has a front face and a rear face. Each strip is capable of light absorption. The rear face of each strip has a plurality of bulbous projections extending outwardly and a plurality of holes. Each of the strips of illuminating material is sized and shaped to be positioned within one of the channels of the tubular member. One of each strip is coupled with the tubular member when the bulbous projections of one of the channels engages the holes of the one strips and the bulbous projections of the one strip engages the holes of the channel. Lastly, the tubular member has one of the two strips of illuminating material positioned within each of the channels. The two strips of illuminating material are exposed to a light source for light absorption, when positioned within the tubular member. The tubular member is illuminated by the light exposed strips of illuminating material. The tubular member is positionable within a container filled with a consumable liquid, with the strips within the channels, for lighting up the liquid.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved illuminated straw device which has all of the advantages of the prior art Straws and none of the disadvantages.

It is another object of the present invention to provide a new and improved illuminated straw device which may be easily and efficiently manufactured and marketed.

It is further object of the present invention to provide a new and improved illuminated straw device which is of durable and reliable constructions.

An even further object of the present invention is to provide a new and improved illuminated straw device which is susceptible of a low cost of manufacture with regard to both materials and labor, and which accordingly is then susceptible of low prices of sale to the consuming public, thereby making such illuminated straw device economically available to the buying public.

Even still another object of the present invention is to provide an illuminated straw device for providing lighted straw for lighting a consumable liquid when the straw is placed within the liquid.

Lastly, it is an object of the present invention to provide a new and improved illuminated straw device including a tubular member defined by an annular wall that has an interior surface and an exterior surface. The tubular member has a channel being formed within the exterior surface. The channel has a channel wall with a plurality of bulbous projections extending outwardly and a plurality of holes therein. Also, at least one strip of an illuminating material is included. The strip has a front face and a rear face with a plurality of bulbous projections extending outwardly and a plurality of holes therein. The strip of illuminating material is sized and shape for positioning within the channel of the tubular member. The strip is coupled with the tubular member when the bulbous projections of the channel engage the holes of the strip and the bulbous projections of the strip engage the holes of the channel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
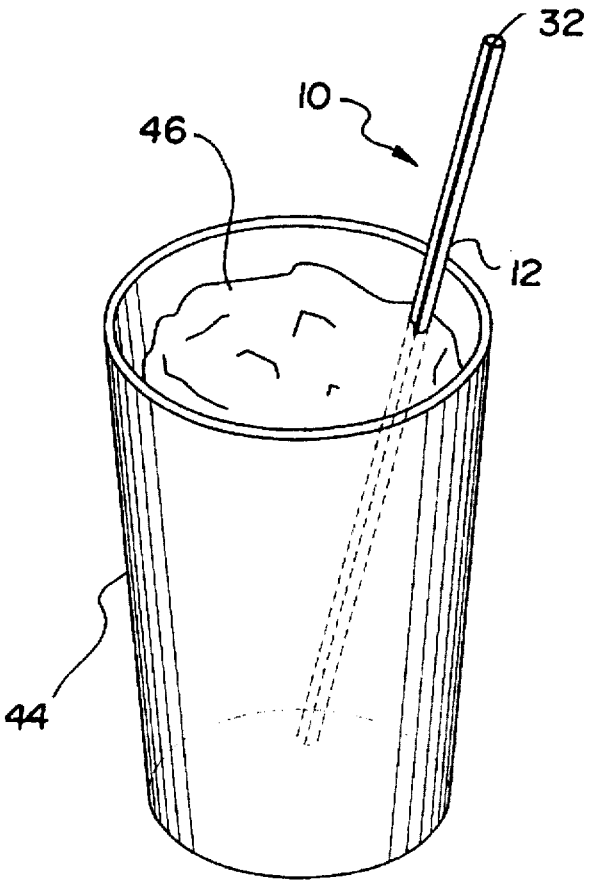
FIG. 1 is a perspective view of the preferred embodiment of the illuminated straw device constructed in accordance with the principles of the present invention.

With reference now to the drawings, and in particular to FIG. 1 thereof, the preferred embodiment of the new and improved illuminated straw device embodying the principles and concepts of the present invention and generally designated by the reference numeral 10 will be described.

The present invention, the illuminated straw device 10 is comprised of a plurality of components. Such components in their broadest context include a tubular member and a strip. Such components are individually configured and correlated with respect to each other so as to attain the desired objective.

Figure 2:
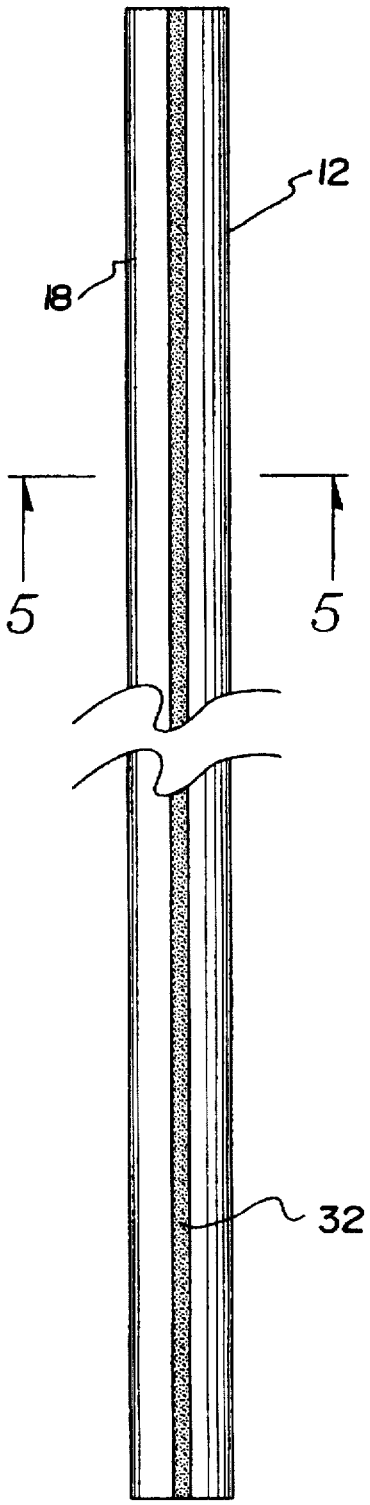
FIG. 2 is a frontal view of the illuminated straw device of the present invention.
Figure 5:
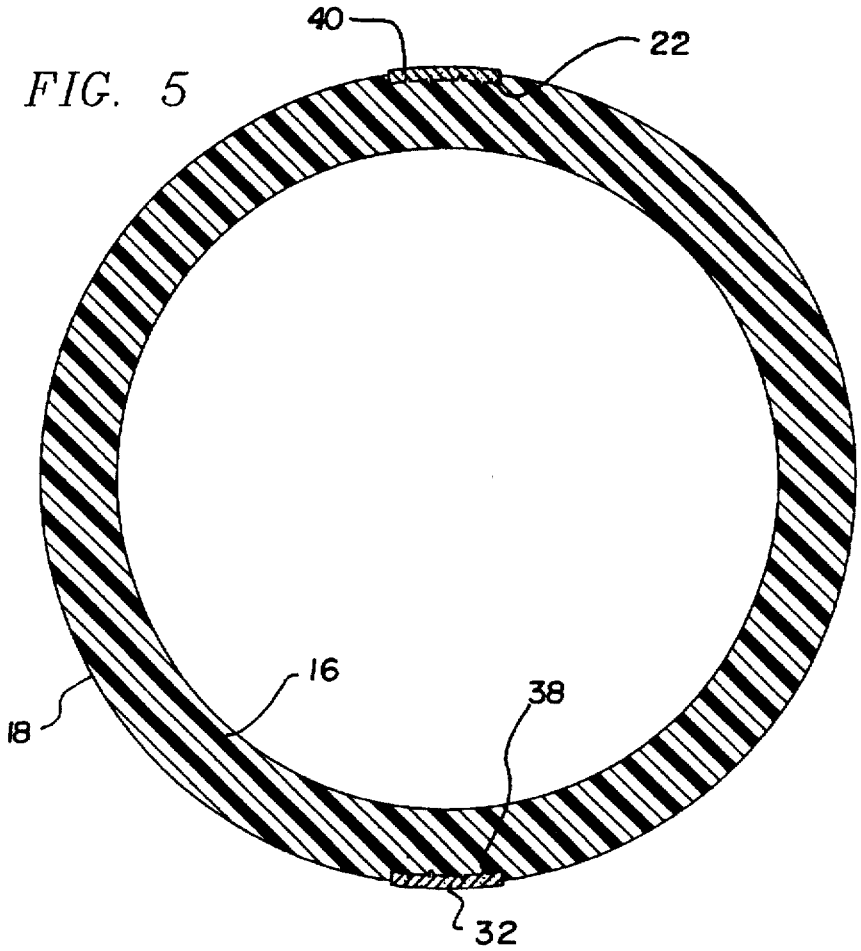
FIG. 5 is a cross-sectional view of the present invention taken along line 5—5 of FIG. 2.

Specifically, the present invention includes an elongated tubular member 12, as shown in FIG. 2. The tubular member is plastic and defined by an annular wall. The annular wall, as seen in FIG. 5, has a interior surface 16 and an exterior surface 18. The tubular member has a length and a circular cross-section. The tubular member has a pair of linear channels 22 that are formed within the exterior surface of the tubular member.

Figure 6:
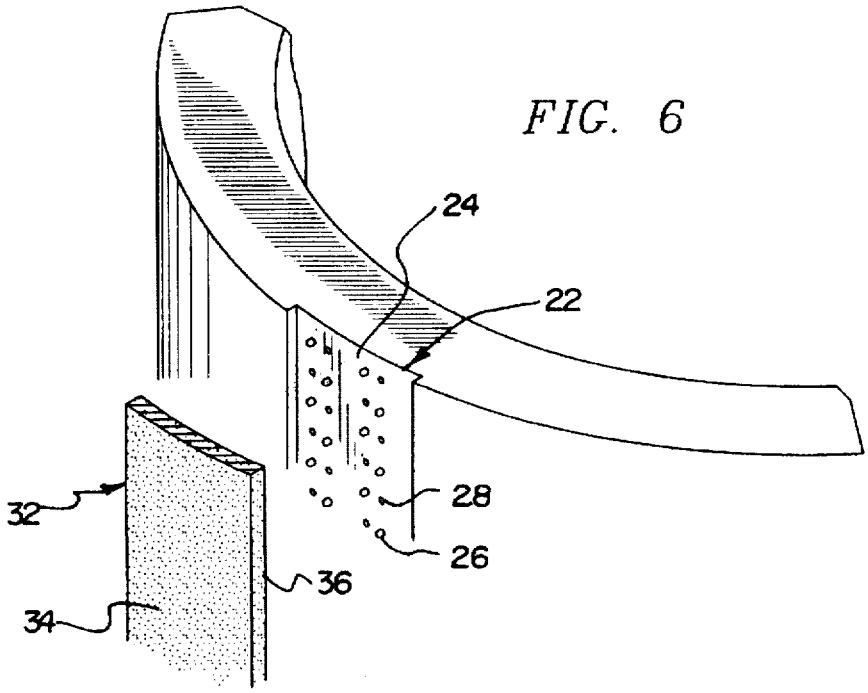
FIG. 6 is an exploded view of the coupling of the strip to the tubular member of the invention of FIG. 2.

Also, the channels, of FIG. 5, extend the length of the tubular member. Each linear channel has a channel wall 24. Each channel wall has a plurality of bulbous projections 26 extending outwardly therefrom and a plurality of holes 28. The plurality of bulbous projections are positioned along the length of the channel wall in an ordered fashion. The plurality of holes are sequentially positioned between the projections and along the length of the channel wall. FIG. 6 provides the best illustration of the alternating placement of the bulbous projections and the holes along the channel of the tubular member.

Additionally, two strips 32 of an illuminating material are included. Each strip has a front face 34 and a rear face 36. Each strip is a phosphorous-impregnated plastic that is light absorbing. The rear face of each strip has a plurality of bulbous projections 38 that extend outwardly therefrom and a plurality of holes 40.

Each of the strips 32 of illuminating material are sized and shape for positioning within one of the channels of the tubular member, as seen in FIG. 5. One of each strip is coupled with the tubular member. The coupling of the strip and tubular member occurs when the bulbous projections 26 of one of the channels engages the holes 40 of one of the strips and the bulbous projections of the one strip engages the holes of the channel 22.

Lastly, the tubular member 12, with one of the two strips of illuminating material positioned in each of the channels, is positioned within a container 44 filled with a drinking liquid 46. Prior to placing the tubular member in the container, the two strips 32 of illuminating material are exposed to a light source for light absorption. The strips are exposed to the light source when each has been positioned within the tubular member. The tubular member is illuminated by the light exposed strips of illuminating material when positioned in the container for lighting up the drinking liquid.

Figure 3:
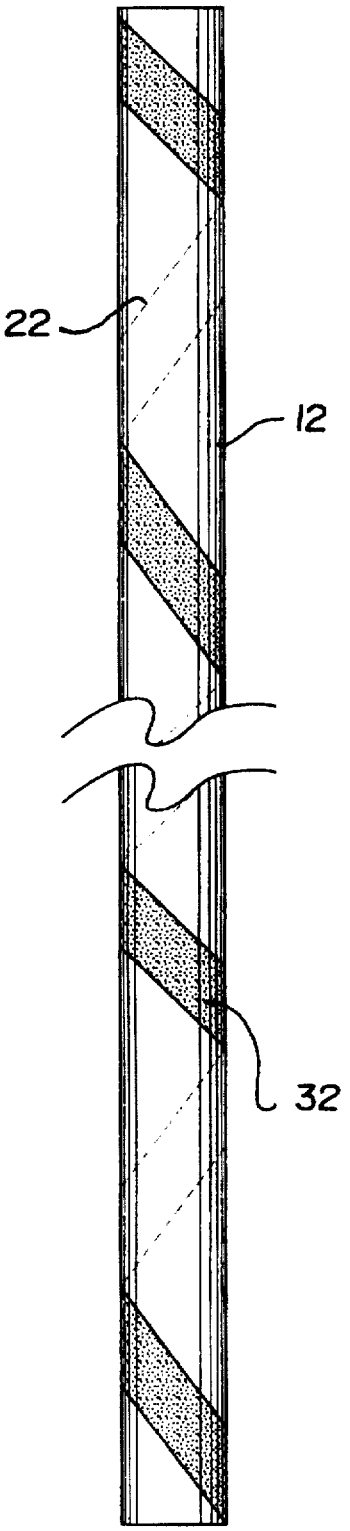
FIG. 3 is one alternative embodiment of the illuminated straw device of the present invention.

Alternatively, as shown in FIG. 3, the tubular member 12 could have a single channel. The single channel is cut in a spiral around the exterior surface. The alternative embodiment requires the placement of a single strip 32 within the channel. The tubular member with the encased strip, of this embodiment functions in an identical manner.

Figure 4:
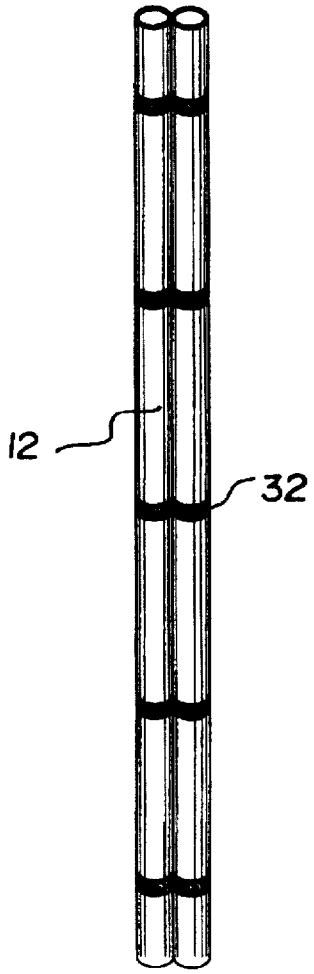
FIG. 4 is another alternative embodiment of the illuminated straw device of the present invention.

Furthermore, as seen in FIG. 4, two tubular members could be attached and have lateral channels. Each tubular member has a plurality of lateral channels that align with the lateral channels of the attached the tubular member. Each lateral channel couples with a strip of illuminated material for lighting up the attached tubular members.

The present invention illuminated straw device is a decoration for any consumable liquid. The straw device will light up the consumable liquid and provide a great conversation piece. The tubular member of the straw device is not limited to the linear structure presented with this application. The tubular member may be structured in a variety of shapes and structural designs. The strips of illuminating material may be formed in a variety of colors and hues prior to coupling with the tubular member. Finally, the strips of illuminating material may be embossed with names, logos and the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved illuminated straw device for illuminating a consumable liquid comprising in combination:

an elongated tubular member defined by an annular wall having an interior surface and an exterior surface, the tubular member having a length and a circular cross-section, the tubular member having a pair of linear channels being formed within the exterior surface thereof and extending the length of the tubular member, each linear channel having a channel wall with a plurality of bulbous projections extending outwardly therefrom and a plurality of holes therein, the plurality of bulbous projections being positioned along the length of the channel wall in an ordered fashion, the plurality of holes being sequentially positioned between the projections and along the length of the channel wall;

two strips of an illuminating material with each strip having a front face and a rear face, each strip being capable of light absorption, the rear face of each strip having a plurality of bulbous projections extending outwardly therefrom and a plurality of holes therein, each of the strips of illuminating material being sized and shaped for positioning within one of the channels of the tubular member, one of each strip being coupled with the tubular member when the bulbous projections of one of the channels engages the holes of the one strip and the bulbous projections of the one strip engages the holes of the channel; and the tubular member having one of the two strips of illuminating material positioned within each of the channels, the two strips of illuminating material being exposed to a light source for light absorption when positioned within the tubular member, the tubular member being illuminated by the light exposed strips of illuminating material, the tubular member being positionable within a container filled with a consumable liquid, with the strips within the channels, for lighting up the liquid.

2. A new and improved illuminated straw device comprising:

a tubular member defined by an annular wall having a interior surface and an exterior surface, the tubular member having a channel being formed within the exterior surface thereof, the channel having a channel wall with a plurality of bulbous projections extending outwardly therefrom and a plurality of holes therein; and at least one strip of an illuminating material having a front face and a rear face with a plurality of bulbous projections extending outwardly therefrom and a plurality of holes therein, the strip of illuminating material being sized and shaped for positioning within the channel of the tubular member, the strip being coupled with the tubular member when the bulbous projections of the channel engage the holes of the strip and the bulbous projections of the strip engage the holes of the channel.

3. The illuminated straw device as set forth in claim 2, wherein the strip being capable of light absorption.

4. The illuminated straw device as set forth in claim 2, wherein the tubular member having a length and a circular cross-section, and being positionable within a container with a consumable liquid.

5. The illuminated straw device as set forth in claim 4, wherein the channel being cut into the exterior surface and spirals the length of the tubular member.

6. The illuminated straw device as set forth in claim 5, wherein the strip of illuminating material being positioned within the channel to spiral around the tubular member.

7. The illuminated straw device as set forth in claim 2, wherein the plurality of bulbous projections being positioned along the length of the channel wall in an ordered fashion, and the plurality of holes being sequentially positioned between the projections and along the length of the channel wall.

8. The illuminated straw device as set forth in claim 2, wherein the strip of illuminating material when positioned within the channel being exposed to a light source for light absorption, the tubular member being illuminated by the light exposed strips of illuminating material when positioned in the container for lighting up the consumable liquid.

9. A new and improved illuminated straw device comprising:

a pair of tubular members fixedly attached with each tubular member defined by an annular wall, the annular wall of each tubular member has a interior surface and an exterior surface, each tubular member having a plurality of lateral channels being formed within the exterior surface thereof, the plurality of lateral channels having a channel wall being cut into the exterior surface, each lateral channel having a plurality of bulbous projections extending outwardly therefrom and a plurality of holes therein; and a plurality of strips of an illuminating material having a front face and a rear face with a plurality of bulbous projections extending outwardly therefrom and a plurality of holes therein, the strips of illuminating material being sized and shaped for positioning within the channel of each of the tubular members, the strips being coupled with the tubular member when the bulbous projections of the channel engage the holes of the strip and the bulbous projections of the strip engage the holes of the channel.

10. The illuminated straw device as set forth in claim 9, wherein the strip being capable of light absorption.

11. The illuminated straw device as set forth in claim 9, wherein each tubular member having a length and a circular cross-section, and being positionable within a container with a consumable liquid.

12. The illuminated straw device as set forth in claim 9, wherein one of each of the strips of illuminating material being positioned within the channel to encircle the exterior surface of each the tubular member.

13. The illuminated straw device as set forth in claim 9, wherein the plurality of bulbous projections being positioned within each of the channel walls in an ordered fashion, and the plurality of holes being sequentially positioned between the projections of the channel walls.

14. The illuminated straw device as set forth in claim 12, wherein the strip of illuminating material when positioned within the channel being exposed to a light source for light absorption, the tubular member being illuminated by the light exposed strips of illuminating material when positioned in the container for lighting up the consumable liquid.

* * * * *